US010448689B2

(12) United States Patent
Hall

(10) Patent No.: US 10,448,689 B2
(45) Date of Patent: Oct. 22, 2019

(54) LIGHTED TRANSLUCENT HAT

(71) Applicant: Asia Hall, Encino, CA (US)

(72) Inventor: Asia Hall, Encino, CA (US)

( * ) Notice: Subject to any disclaimer, the term of this patent is extended or adjusted under 35 U.S.C. 154(b) by 0 days.

(21) Appl. No.: 14/690,532

(22) Filed: Apr. 20, 2015

(65) Prior Publication Data

US 2016/0305645 A1 Oct. 20, 2016

(51) Int. Cl.
*A42B 1/00* (2006.01)
*A42B 1/24* (2006.01)

(52) U.S. Cl.
CPC ..... *A42B 1/244* (2013.01)

(58) Field of Classification Search
CPC ..... F21V 33/0008; A42B 3/0433
USPC ..... 362/106
See application file for complete search history.

(56) References Cited

U.S. PATENT DOCUMENTS 4,570,206 A * 2/1986 Deutsch ..... A41D 27/085 2/115
5,495,622 A * 3/1996 Kaufman ..... A42C 5/04 2/175.1
6,499,145 B1 12/2002 Kates
7,052,154 B2 5/2006 Vanderschuit
2003/0151910 A1* 8/2003 Marston ..... A43B 1/0036 362/106
2004/0031287 A1* 2/2004 Leason ..... A44C 15/0015 63/1.13
2004/0156955 A1* 8/2004 Klima ..... A23G 3/563 426/104
2006/0215393 A1* 9/2006 VanderSchuit ..... G09F 21/02 362/106
2007/0064413 A1* 3/2007 Slater ..... A42B 1/244 362/106
2014/0354153 A1* 12/2014 Pulido, Jr. ..... H05B 33/0854 315/77

* cited by examiner

*Primary Examiner* — Gerald J Sufleta, II
(74) *Attorney, Agent, or Firm* — Akerman LLP; Mammen (Roy) P. Zachariah, Jr.

(57) ABSTRACT

A hat is provided, comprising a brim, a crown, electroluminescent (EL) wire forming an outline at least around the brim and the crown, a battery pack secured to the underside of the crown, and a controller, secured to the underside of the crown and electrically coupled to the battery pack and the EL wire, configured to control the current applied to the EL wire. The brim and crown are formed from a translucent material. A method of manufacturing a hat is also provided, comprising: providing a translucent material, forming a brim and crown of the translucent material, securing an electroluminescent (EL) wire around at least the brim and crown, providing a battery pack, providing a controller, electrically coupling the EL wire to the battery pack and controller, and securing the battery pack and controller to the underside of the crown.

20 Claims, 7 Drawing Sheets

LIGHTED TRANSLUCENT HAT

RELATED APPLICATION DATA

The present application is related to commonly-assigned U.S. Provisional Application Ser. No. 61/976,770, entitled A WEARABLE COWBOY HAT LINED WITH EL WIRE THAT LIGHTS UP, filed on Apr. 8, 2014, which application is incorporated herein by reference in its entirety.

TECHNICAL FIELD

The present invention relates generally to headwear and, in particular, to a lighted, translucent hat.

BACKGROUND ART

Although the basic cowboy hat has traditionally been a work hat, more recently they have also become fashion wear and are being worn at entertainment venues.

SUMMARY OF THE INVENTION

The present invention provides a hat, comprising a brim, a crown, electroluminescent (EL) wire forming an outline at least around the brim and the crown, a battery pack secured to the underside of the crown, and a controller, secured to the underside of the crown and electrically coupled to the battery pack and the EL wire, configured to control the current applied to the EL wire. The brim and crown are formed from a translucent material.

The present invention also provides a method of manufacturing a hat, comprising: providing a translucent material, forming a brim and crown of the translucent material, securing an electroluminescent (EL) wire around at least the brim and crown, providing a battery pack, providing a controller, electrically coupling the EL wire to the battery pack and controller, and securing the battery pack and controller to the underside of the crown. The controller is configured to control the current applied to the EL wire.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
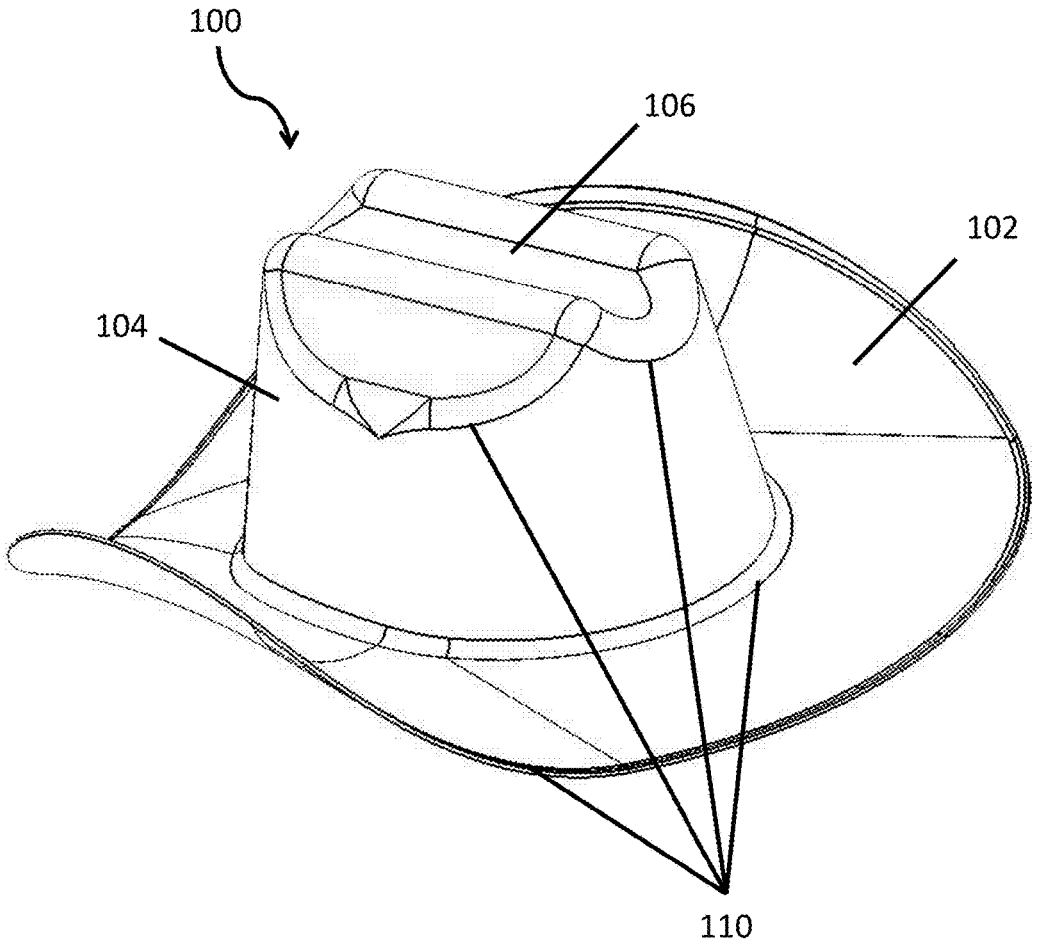
FIG. 1 is a perspective outline view of an embodiment of a lighted, translucent hat of the present invention.

FIG. 1 is a perspective outline view of an embodiment of a lighted, translucent hat 100 of the present invention. The hat 100 illustrated in the FIGs. is a cowboy hat but the present invention is not limited to any one particular style of hat. The hat 100 includes a brim 102, a crown 104, and several creases 106 providing the overall shape of the hat 100. The hat 100 may be formed from a molded or plastic injected translucent material. As used herein, the term "translucent" refers to material through which at least some light may be transmitted and includes "transparent" material. If desired, ventilation holes may be formed in the crown 104 of the hat 100.

Figure 2:
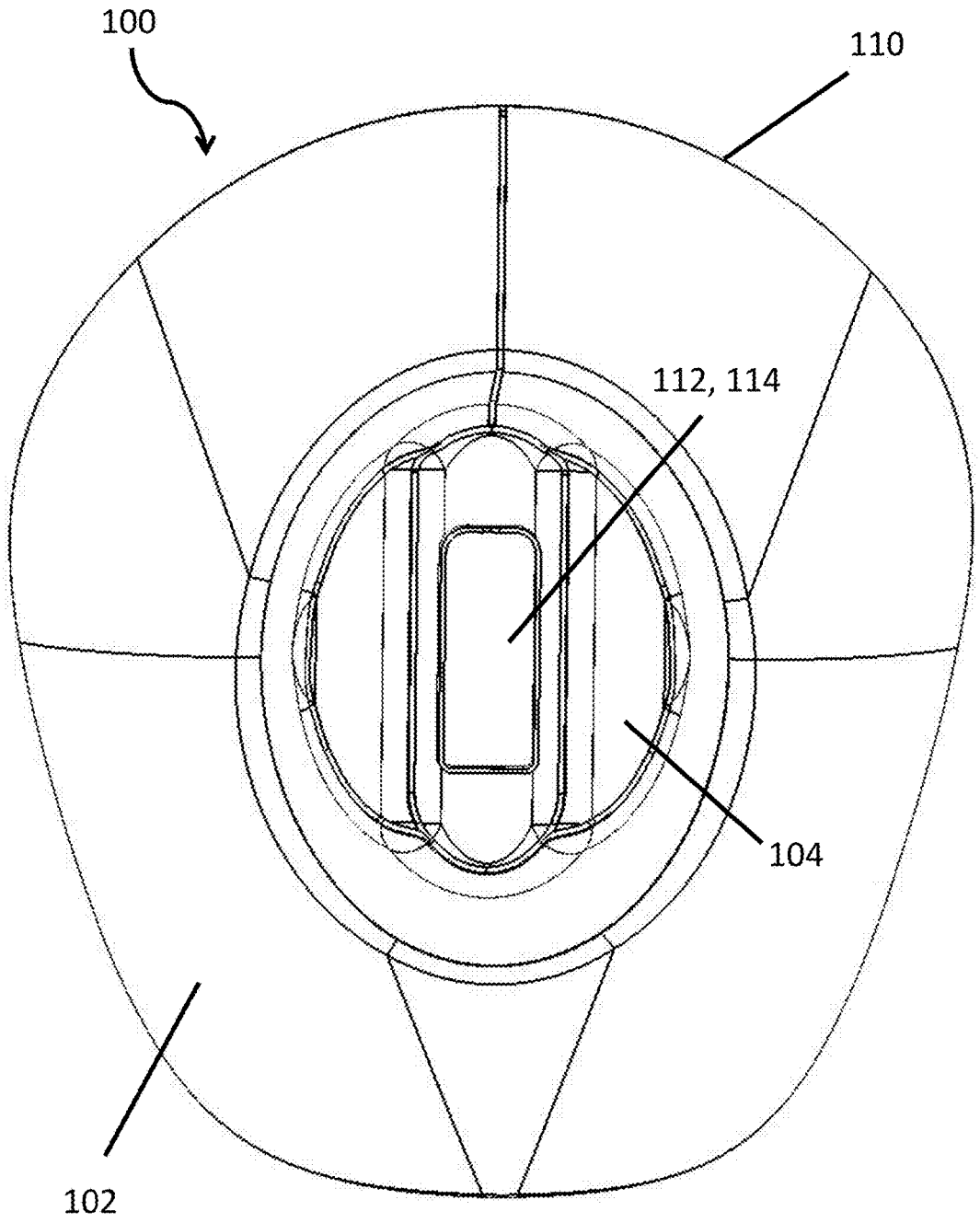
FIG. 2 is a bottom outline view of the hat of FIG. 1.
Figure 3:
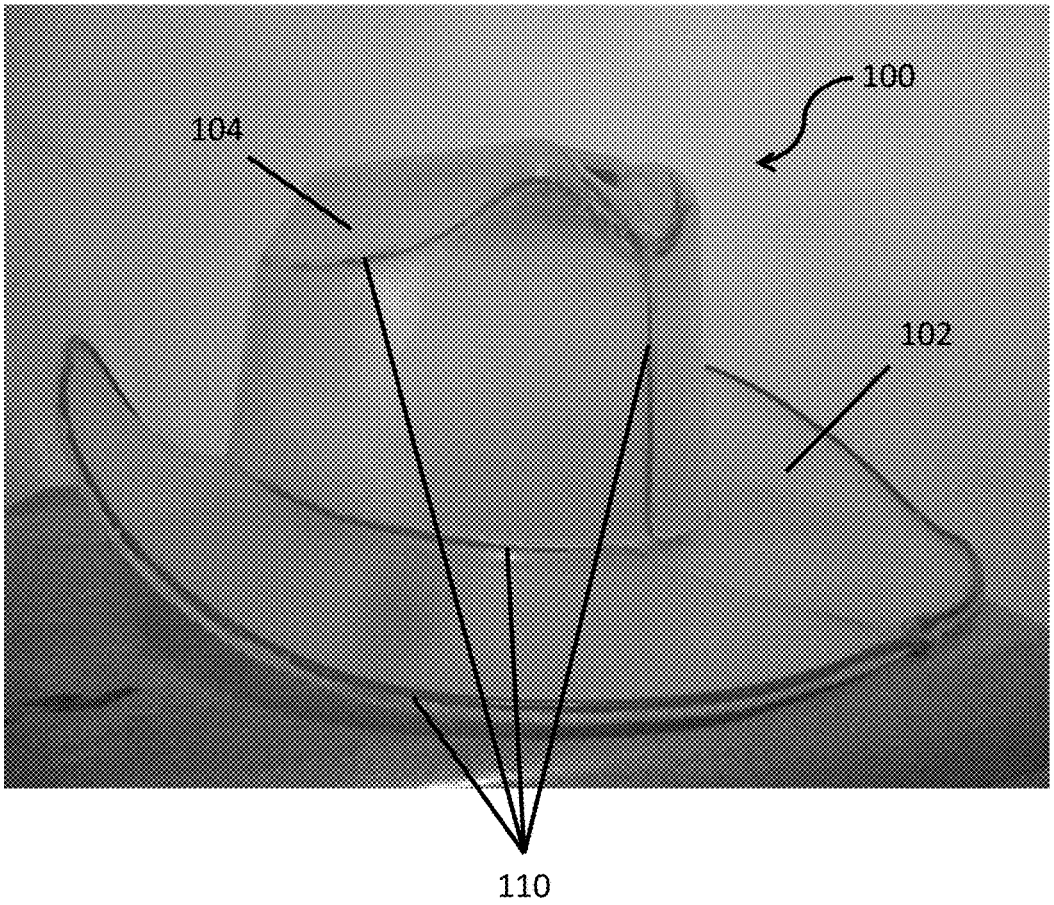
FIG. 3 is a perspective view of the hat of FIG. 1.
Figure 4:
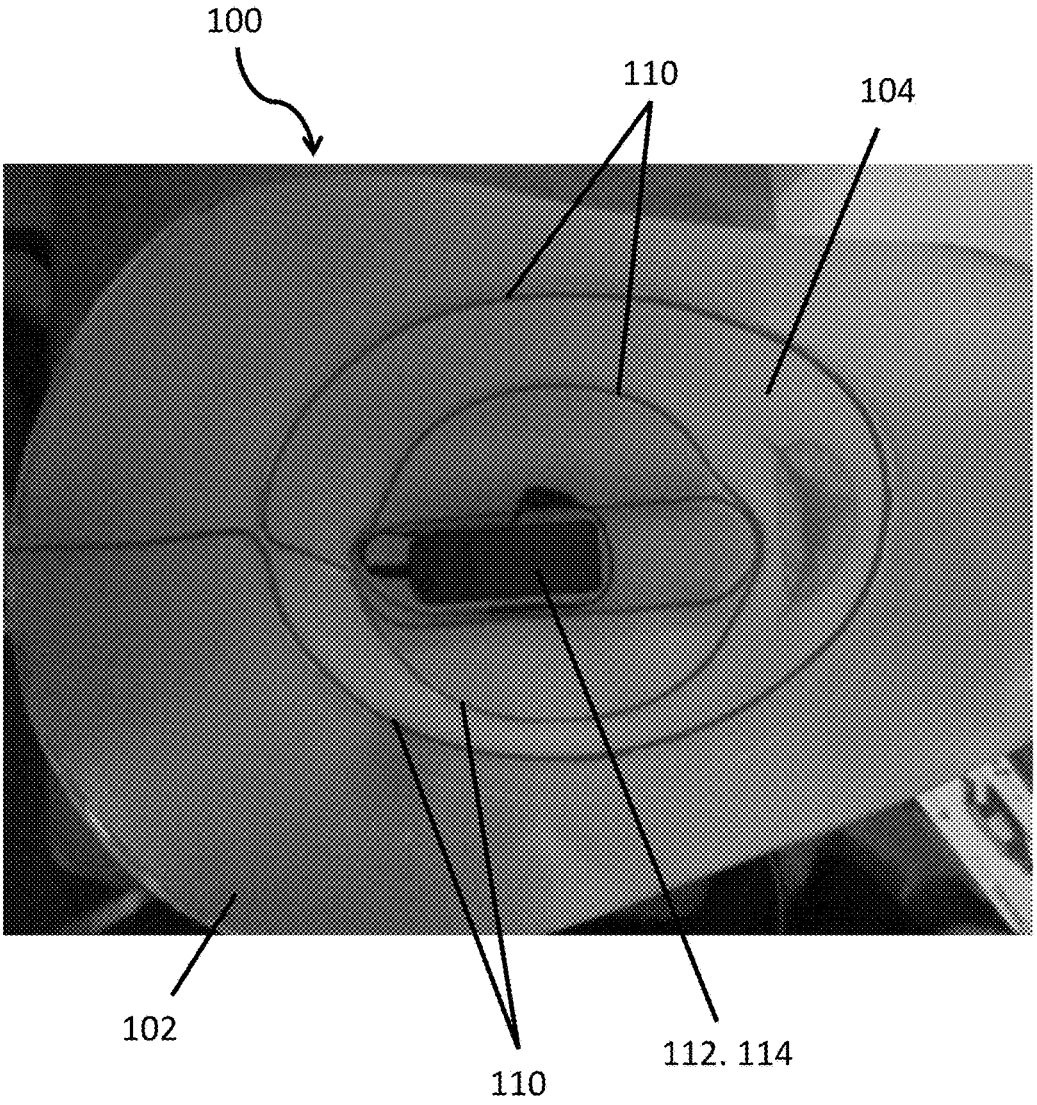
FIG. 4 is a bottom view of the hat of FIG. 1.

The hat 100 further includes flexible electroluminescent (EL) wire 110 secured to the material or molded or embedded into the hat 100, such as around perimeter of the brim 102 and crown 104, as illustrated in FIGS. 3 and 4. A battery pack 112 and controller 114, are electrically coupled to the EL wire 110, as illustrated in the block diagram of FIG. 5. The battery pack 112 and controller 114, which may be contained in a single housing or may be separate units, may be secured in the underside of the crown (FIGS. 2 and 4). As is known, when a current from the battery pack 112 through the controller 114 is applied to the EL wire 110, the wire 110 emits light.

Figure 6:
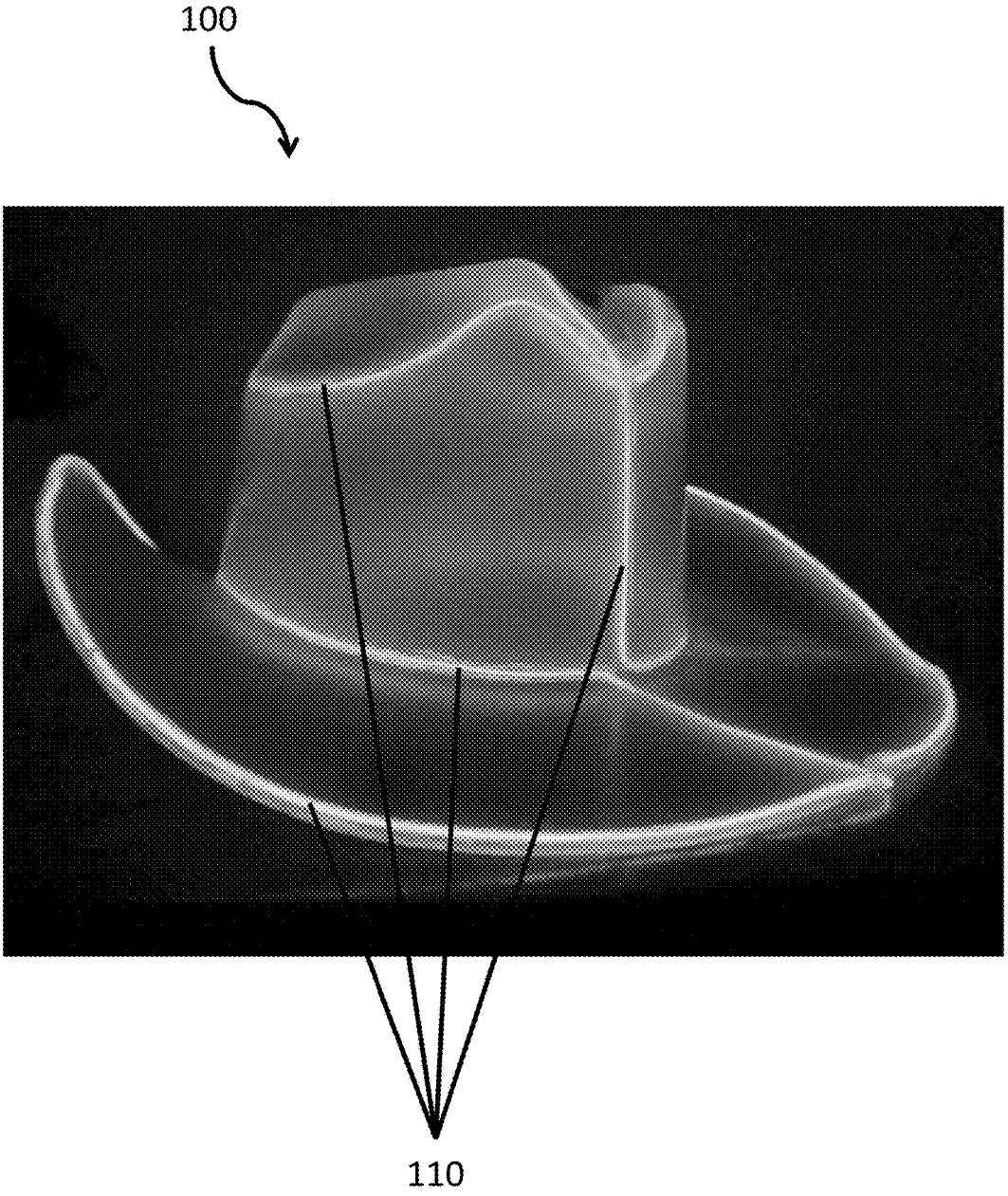
FIG. 6 is a is a perspective view of the hat of FIG. 1 in the lighted state.
Figure 7:
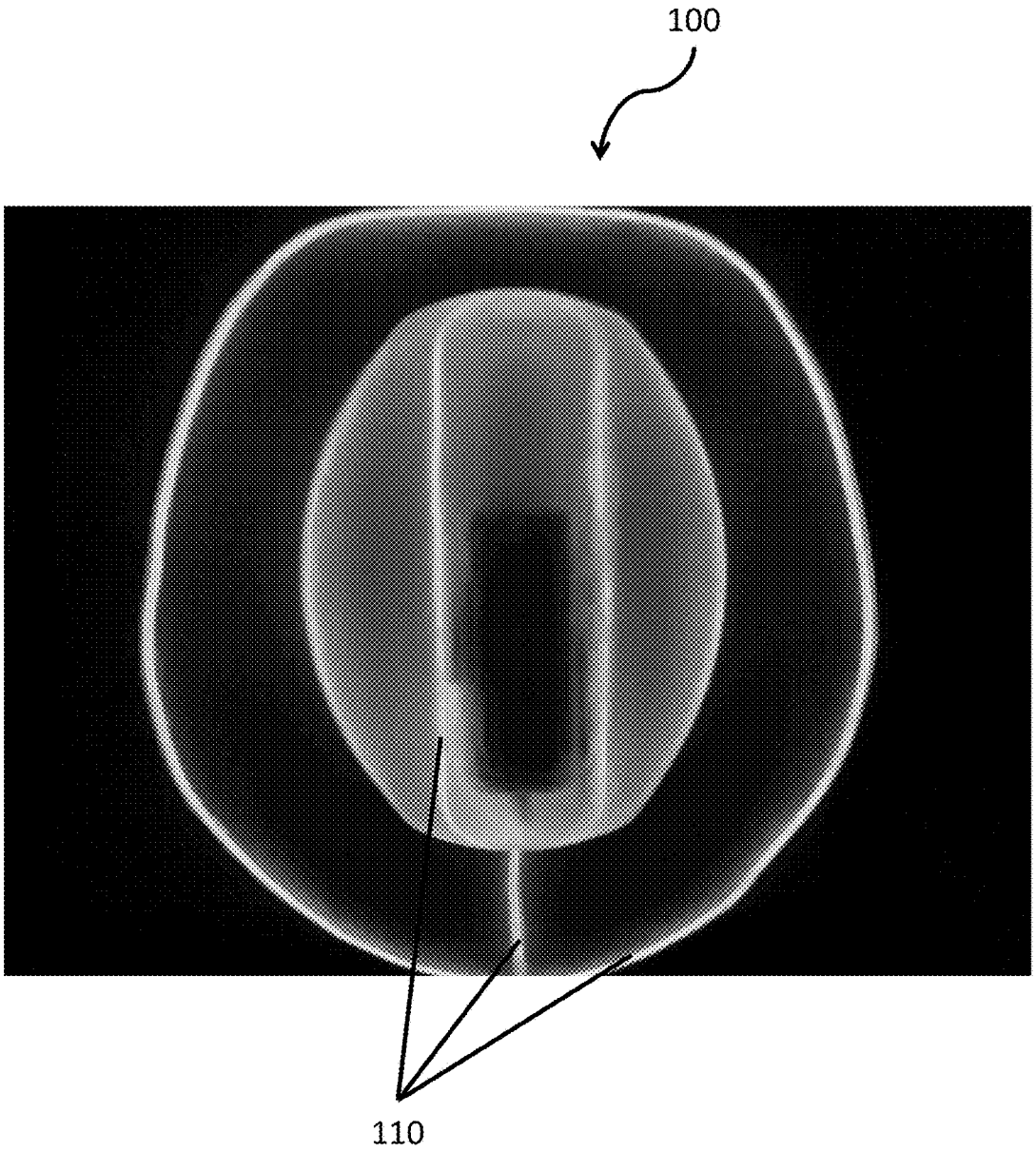
FIG. 7 is a is a top view of the hat of FIG. 1 in the lighted state.

FIGS. 6 and 7 illustrate the hat 100 with the EL wire 110 in the lighted state. The translucent material of the hat 100 allows the light to be disbursed throughout the hat 100, causing much or all of the hat 100 to glow. Because the EL wire 110 is available in a variety of colors, the hat 100 will glow with whatever color EL wire is selected. Alternatively, or in addition, the translucent material of the hat 100 may be of any of a variety of colors, enhancing the glow of the hat 100 when the EL wires are in the lighted state and providing color to the hat 100 when the EL wires are in the unlighted state. Further, the controller 114 may provide a variety of programmed light sequences, selectable by the wearer of the hat, including, but not limited to, continuously on, flashing at one of several selectable fixed rates, and flashing at one of several selectable patterns. The controller 114 may also include a microphone and appropriate sound-activated circuitry to convert sounds, such as music, into control signals such that the EL wire 110 flashes in time to the sound.

Figure 5:
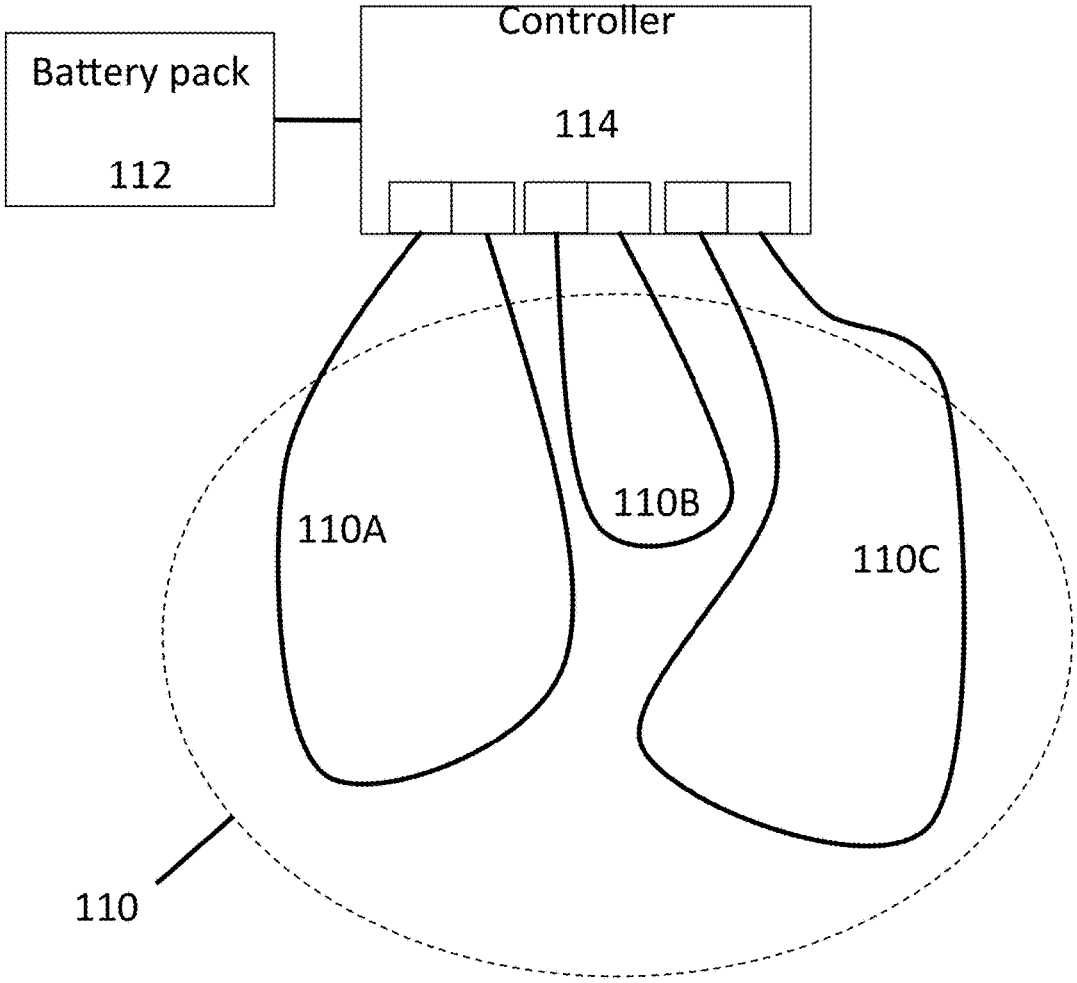
FIG. 5 is an embodiment of an electrical block diagram of the hat of FIG. 1.

Black light reactive material may also be embedded into the translucent material of the hat 100 to provide additional light effects in the dark. If desired, a logo or other writing or design may be applied to or embedded in the hat 100, such as at the front of the crown 104, to provide a glowing cattle brand effect when the EL wire is lit. The brand may be applied as paint or the like, or may be formed from EL wire 100. With an appropriate controller 114, EL wire 100 of different colors may be used and may be controlled separately. FIG. 5 illustrates a circuit having three different EL wires 110A, 110B, 110C, each coupled to different connectors of the controller 114, allowing for individual control of each of the EL wires 110A, 110B, 110C, selectable by the wearer of the hat.

As previously noted, it will be appreciated that, although the hat described and illustrated herein is a cowboy hat, the present invention is not limited to this embodiment but may also include any other style of hat, including, but not limited to, baseball hats.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A hat, comprising:

a brim;

a crown including a crease portion located centrally on the crown, wherein the brim and the crown are formed from a translucent material, wherein the translucent material is plastic injected, wherein the crown includes a left crease portion adjacent to a left side of the crease portion and a right crease portion adjacent to a right side of the crease portion;

electroluminescent (EL) wire embedded within a perimeter of the brim, embedded within a perimeter of the crown, embedded within a perimeter of the crease portion, embedded entirely within a perimeter of a bottom portion of the crown that intersects with the brim, embedded within a perimeter of the left crease portion and a perimeter of the right crease portion, and embedded within a portion of the brim that extends from the bottom portion of the crown that intersects with the brim to an edge of the brim, such that the EL wire forms an outline of the hat and that the EL wire disburses light throughout the hat, wherein a glow of the hat is enhanced when the EL wire is in a lighted state and the light is disbursed throughout the hat, and wherein the translucent material provides color to the hat when the EL wire is in an unlighted state;

a battery pack secured to the underside of the crease portion of the crown; and a controller, secured to the underside of the crease portion of the crown and electrically coupled to the battery pack and the EL wire, configured to control the current applied to the EL wire, wherein the controller is connected to the EL wire via a series of connectors of the controller, wherein the EL wire comprises a plurality of EL wires that are connected to the series of connectors of the controller that allow for individual control of each EL wire of the plurality of EL wires and that are selectable by a wearer of the hat, wherein the controller is housed in a separate housing from the battery pack and the separate housing is secured to the underside of the crease portion of the crown, wherein the controller comprises a microphone and sound-activated circuitry secured to the underside of the crease portion of the crown that converts received sounds into control signals that cause the EL wire to flash the light in accordance with the sounds.

2. The hat of claim 1, wherein the plurality of EL wires include a first EL wire, a second EL wire located at the crease, a third EL wire located at the intersection of the brim and the crown, and a fourth EL wire located at the intersection of the brim and the crown and extending to the edge of the brim, and wherein the first EL wire is positioned vertically between a top portion of the crown and the bottom portion of the crown that intersects with the brim and provides an appearance of connecting the second EL wire located at the crease with the third EL wire located at the intersection of the brim and the crown.

3. The hat of claim 1, wherein the EL wire is embedded into the translucent material.

4. The hat of claim 1, wherein the controller is configured to provide a plurality of user-selectable lighting programs.

5. The hat of claim 1, wherein the EL wire comprises a plurality of EL wires separately coupled to and controlled by the controller.

6. The hat of claim 5, wherein each of the plurality of EL wires comprises a different color.

7. The hat of claim 5, wherein the controller is configured to provide a plurality of user-selectable lighting programs for the plurality of EL wires.

8. The hat of claim 1, wherein the translucent material is formed in a shape of a cowboy hat.

9. The hat of claim 1, wherein the translucent material is a colored material.

10. A method of manufacturing a hat, comprising:

providing a translucent material;

forming a brim and a crown from the translucent material, wherein the crown includes a crease portion, wherein the translucent material is plastic injected, wherein the crown includes a left crease portion adjacent to a left side of the crease portion and a right crease portion adjacent to a right side of the crease portion;

embedding an electroluminescent (EL) wire within a perimeter of the brim, within a perimeter of the crown, within a perimeter of the crease portion, entirely within a perimeter of a bottom portion of the crown that intersects with the brim, embedded within a perimeter of the left crease portion and a perimeter of the right crease portion, and embedded within a portion of the brim that extends from the bottom portion of the crown that intersects with the brim to an edge of the brim, such that the secured EL wire forms an outline of the hat and that the EL wire disburses light throughout the hat, wherein a glow of the hat is enhanced when the EL wire is in a lighted state and the light is disbursed throughout the hat, and wherein the translucent material provides color to the hat when the EL wire is in an unlighted state;

providing a battery pack;

providing a controller;

electrically coupling the EL wire to the battery pack and controller, the controller configured to control the current applied to the EL wire, wherein the controller is connected to the EL wire via a series of connectors of the controller, wherein the EL wire comprises a plurality of EL wires that are connected to the series of connectors of the controller that allow for individual control of each EL wire of the plurality of EL wires and that are selectable by a wearer of the hat; and securing the battery pack in a first housing and the controller in a second housing to the underside of the crease portion of the crown, wherein the first and second housings are secured to the underside of the crease portion of the crown.

11. The method of claim 10, wherein embedding the EL wire within the perimeter of the brim comprises embedding the EL wire within the brim such that a portion of the surface of the EL wire is in contact with the edge of the brim along a distance of the perimeter of the brim.

12. The method of claim 10, wherein embedding the EL wire within the perimeter of the brim and the perimeter of the crown comprises embedding the EL wire within the translucent material.

13. The method of claim 10, wherein embedding the EL wire within the perimeter of the brim and perimeter of the crown comprises embedding the plurality of EL wires within at least the brim and the crown.

14. The method of claim 13, wherein each of the plurality of EL wires comprises a different color.

15. The method of claim 13, wherein providing the controller comprises providing a controller configured to be coupled to the plurality of EL wires and to separately control each EL wire with a user-selectable lighting program.

16. The method of claim 13, wherein providing the controller comprises providing a controller configured to provide a plurality of user-selectable lighting programs.

17. The method of claim 13, wherein providing the translucent material comprises providing a colored translucent material.

18. A hat, comprising:

a brim;

a crown including a crease portion, wherein the brim and the crown are formed from a translucent material, wherein the translucent material is plastic injected, wherein the crown includes a left crease portion adjacent to a left side of the crease portion and a right crease portion adjacent to a right side of the crease portion;

electroluminescent (EL) wire embedded within a perimeter of the brim, embedded within a perimeter of the crown, embedded within a perimeter of the crease portion, embedded entirely within a perimeter of a bottom portion of the crown that intersects with the brim, embedded within a perimeter of the left crease portion and a perimeter of the right crease portion, and embedded within a portion of the brim that extends from the bottom portion of the crown that intersects with the brim to an edge of the brim, such that the EL wire forms an outline of the hat and that the EL wire disburses light throughout the hat, wherein a glow of the hat is enhanced when the EL wire is in a lighted state and the light is disbursed throughout the hat, and wherein the translucent material provides color to the hat when the EL wire is in an unlighted state;

a battery pack secured to the underside of the crease portion of the crown; and a controller, secured to the underside of the crease portion of the crown and electrically coupled to the battery pack and the EL wire, configured to control the current applied to the EL wire, wherein the controller is connected to the EL wire via a series of connectors of the controller, wherein the EL wire comprises a plurality of EL wires that are connected to the series of connectors of the controller that allow for individual control of each EL wire of the plurality of EL wires and that are selectable by a wearer of the hat, wherein the controller is housed in a first housing and the battery pack is housed in a second housing, wherein the first and second housings are secured to the underside of the crease portion of the crown.

19. The hat of claim 18, wherein the EL wire is further positioned vertically between a top portion of the crown and the bottom portion of the crown that intersects with the brim.

20. The hat of claim 18, wherein the hat further comprises a microphone and sound-activated circuitry that converts received sounds into control signals that cause the EL wire to flash the light in accordance with the sounds.

* * * * *